US011982460B2

(12) United States Patent
Knelsen

(10) Patent No.: US 11,982,460 B2
(45) Date of Patent: May 14, 2024

(54) APPLIANCE AIR INTAKE APPARATUS

(71) Applicant: Wayne Knelsen, La Crete (CA)

(72) Inventor: Wayne Knelsen, La Crete (CA)

( * ) Notice: Subject to any disclaimer, the term of this patent is extended or adjusted under 35 U.S.C. 154(b) by 191 days.

(21) Appl. No.: 16/859,205

(22) Filed: Apr. 27, 2020

(65) Prior Publication Data

US 2021/0333009 A1 Oct. 28, 2021

(51) Int. Cl.

| | |
|---|---|
| ***F24F 13/02*** | (2006.01) |
| ***F24F 8/108*** | (2021.01) |
| ***F24F 13/22*** | (2006.01) |
| ***F24F 13/28*** | (2006.01) |

(52) U.S. Cl.

CPC ..... *F24F 13/02* (2013.01); *F24F 13/222* (2013.01); *F24F 13/28* (2013.01); *F24F 8/108* (2021.01)

(58) Field of Classification Search

CPC .... F24F 13/02; F02M 35/082; F02M 35/0214
USPC ..... 454/234; 55/482
See application file for complete search history.

(56) References Cited

U.S. PATENT DOCUMENTS

| | | | | |
|---|---|---|---|---|
| 3,994,280 | A | 11/1976 | Winters et al. | |
| 4,161,941 | A | 7/1979 | Bloxham | |
| 4,329,967 | A | 5/1982 | Levenberg | |
| 4,335,704 | A | 6/1982 | Wingstrom et al. | |
| 5,282,456 | A | 2/1994 | Smelcer et al. | |
| 6,102,030 | A | 8/2000 | Brown et al. | |
| 8,505,529 | B2 | 8/2013 | King | |
| 8,658,944 | B2 | 2/2014 | Clemenz et al. | |
| 8,939,141 | B2 | 1/2015 | Krueger | |
| 2006/0026935 | A1* | 2/2006 | Huang | B01D 50/20 55/337 |
| 2019/0388820 | A1* | 12/2019 | Niakan | B01D 46/2411 |

FOREIGN PATENT DOCUMENTS

| | | | |
|---|---|---|---|
| CA | 3006214 | A1 | 6/2016 |

* cited by examiner

*Primary Examiner* — Vivek K Shirsat
(74) *Attorney, Agent, or Firm* — Orin Del Vecchio

(57) ABSTRACT

An air intake apparatus configured to be operably coupled to a primary air input of a furnace so as to provide airflow into the furnace in the event the primary air input becomes blocked. The air intake apparatus includes a body having an interior volume wherein the body includes a first end and a second end. The body has openings at the first end and the second end. A first end cap member is secured to the first end and includes an intake pipe operably coupled thereto. An intake member is secured to the second end cap member and extends upward therefrom into the interior volume of the body. The body includes a plurality of apertures formed in the wall thereof operable to atmospherically couple the interior volume of the body to an atmosphere in which the air intake apparatus is present.

17 Claims, 4 Drawing Sheets

APPLIANCE AIR INTAKE APPARATUS

FIELD OF INVENTION

The present invention relates generally to HVAC appliances such as but not limited to furnaces wherein the present invention is configured to operably couple to an air intake of the appliance and provide the ability for the appliance to utilize air from the interior of the structure of which it is installed in the event the primary air intake becomes inoperable from freezing.

BACKGROUND

As is known in the art, appliances utilized in heating and cooling of structures such as but not limited to residential homes utilize fresh air and provide conditioning thereof for distribution through the structure. By way of example but not limitation, in colder climates most residential structures will have a furnace that will provide warm air to the interior of the structure so as to maintain a palpable temperature. A typical furnace will utilize gas or propane to ignite the burner. The flames of the burner will heat up a metal heat exchanger and exhaust out of the flue. The furnace draws in fresh air through an air intake and the heat exchanger transfers its heat to the incoming air. The furnace is equipped with a blower which is configured to transfer the heated air into a duct network and distribute into the home. As the warm air fills each of the rooms of the home the colder denser air is drawn back into the furnace via the return ducts and the process is repeated.

One problem homeowners encounter in cold climates is the potential freezing over of the air intake. In harsh winter climates the air intake can become frozen wherein the air is unable to be drawn into the furnace. Without a supply of fresh air, the furnace either becomes completely inoperable or loses a significant portion of its efficiency and is unable to maintain a warm temperature within the home. Loss of temperature control within the home during cold weather causing damage such as but not limited to frozen plumbing pipes which can burst and subsequently cause further damage.

It is intended within the scope of the present invention to provide an air intake apparatus for a furnace that provides a technique for the furnace to draw air thereinto from the interior of the structure in the event the primary air intake of the furnace becomes clogged from freezing or other reasons.

SUMMARY OF THE INVENTION

It is the object of the present invention to provide an appliance air intake apparatus that is operable to provide an ability to utilize intake air from within the structure in which the appliance is installed wherein the apparatus is operably coupled with the fresh air intake of the appliance.

Another object of the present invention is to provide a furnace air intake apparatus configured to be installed on the air intake line of the furnace wherein the furnace air intake apparatus includes a body that is cylindrical in shape having an interior volume.

A further object of the present invention is to provide an appliance air intake apparatus that is operable to provide an ability to utilize intake air from within the structure in which the appliance is installed wherein the body has a first end and a second end wherein the first end and second end have openings.

Still another object of the present invention is to provide a furnace air intake apparatus configured to be installed on the air intake line of the furnace wherein the furnace air intake apparatus wherein the first end includes a cap member releasably secured thereto.

An additional object of the present invention is to provide an appliance air intake apparatus that is operable to provide an ability to utilize intake air from within the structure in which the appliance is installed wherein the second end includes a cap member releasably secured thereto.

Yet a further object of the present invention is to provide a furnace air intake apparatus configured to be installed on the air intake line of the furnace wherein the first end cap member includes an intake pipe journaled therethrough having a portion disposed within the interior volume of the body and a portion extending outward from the first end cap member.

Another object of the present invention is to provide an appliance air intake apparatus that is operable to provide an ability to utilize intake air from within the structure in which the appliance is installed wherein the second cap member has an air intake member secured thereto wherein the air intake member extends inward into the interior volume of the body.

An alternate object of the present invention is to a furnace air intake apparatus configured to be installed on the air intake line of the furnace wherein in the air intake member includes apertures formed in the wall thereof.

Still a further object of the present invention is to provide an appliance air intake apparatus that is operable to provide an ability to utilize intake air from within the structure in which the appliance is installed wherein the wall of the body includes apertures operable to atmospherically couple the interior volume of the body with the atmosphere adjacent the furnace.

An additional object of the present invention is to provide a furnace air intake apparatus configured to be installed on the air intake line of the furnace wherein the interior surface of the body can include a mesh lining.

A further object of the present invention is to provide an appliance air intake apparatus that is operable to provide an ability to utilize intake air from within the structure in which the appliance is installed wherein the intake member can have a mesh screen on the exterior surface thereof.

An alternative objective of the present invention is to provide a furnace air intake apparatus configured to be installed on the air intake line of the furnace wherein the intake member is operable to trap condensate and inhibit introduction into the combustion chamber of the furnace.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
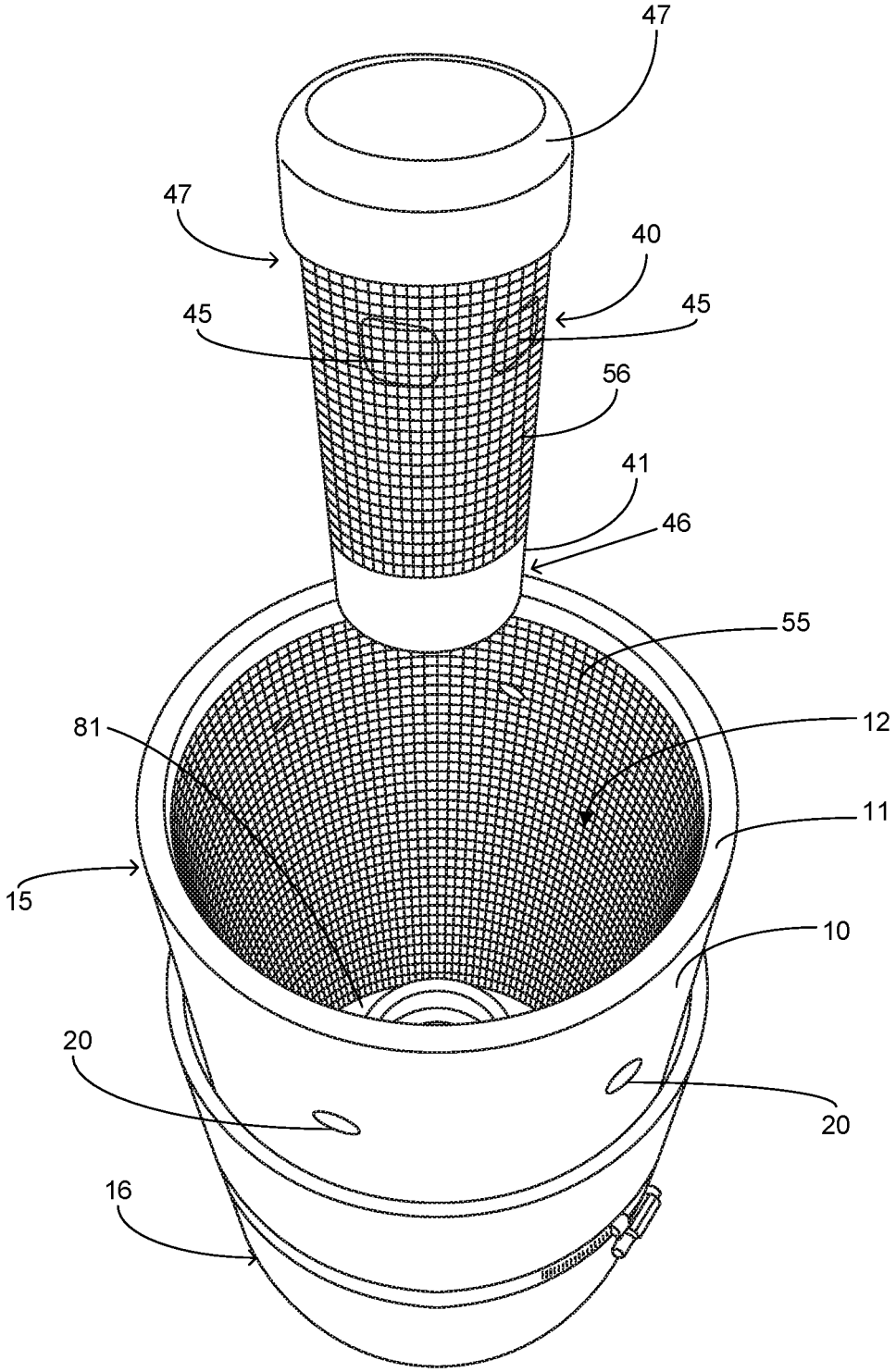
FIG. 1 is a view of the intake member removed from the interior volume of the body.
Figure 2:
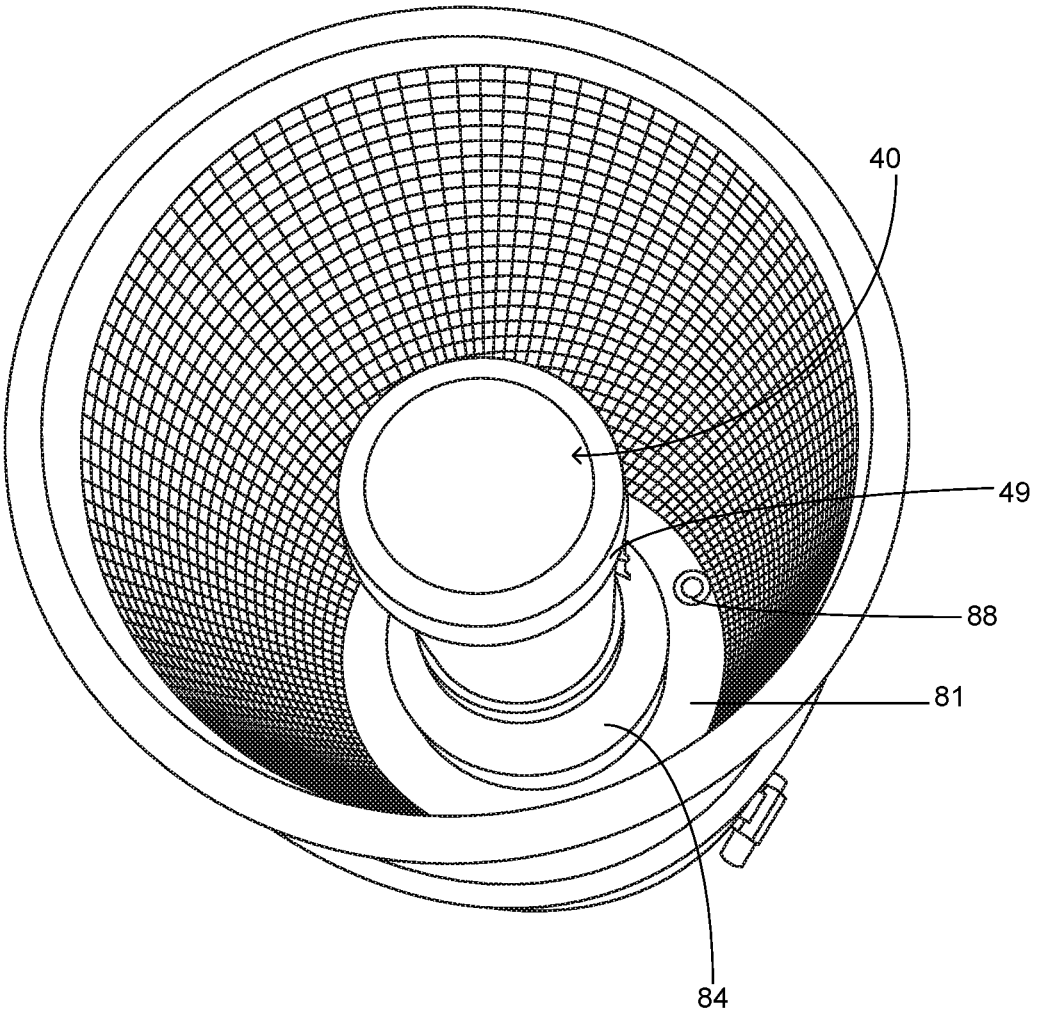
FIG. 2 is an interior view of the body with the intake member installed.
Figure 3:
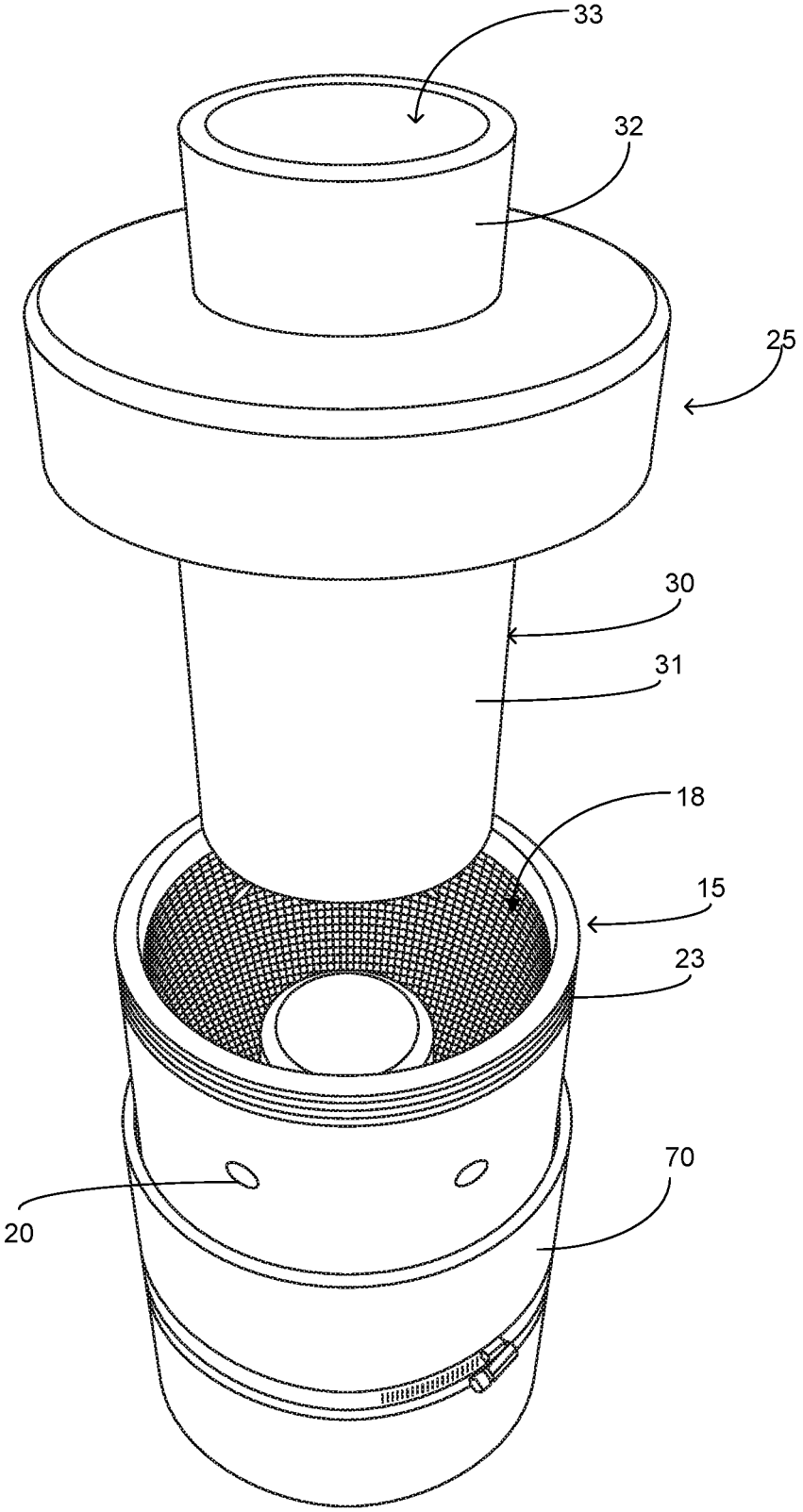
FIG. 3 is a perspective view of the body with the first end cap member removed therefrom.

Referring now to the drawings submitted herewith, wherein various elements depicted therein are not necessarily drawn to scale and wherein through the views and figures like elements are referenced with identical reference numerals, there is illustrated an appliance air intake apparatus 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Now referring to the Figures submitted as a part hereof, the appliance air intake apparatus 100 includes a body 10. The body 10 is manufactured from a durable rigid material such as but not limited to plastic. The body 10 is cylindrical in shape having a wall 11. The body 10 includes an interior volume 12 wherein the body 10 is substantially hollow. The body 10 includes a first end 15 and a second end 16 wherein the first end 15 and second end 16 each have an opening providing access to the interior volume 12. While the body 10 is illustrated herein as being cylindrical in shape, it is contemplated within the scope of the present invention that the body 10 could be provided in alternate shapes and sizes. The wall 11 of the body 10 has apertures 20 journaled therethrough. The apertures 20 provide an atmospheric coupling of the interior volume 12 of the body 10 with the surroundings of the appliance air intake apparatus 100. As will be further discussed herein, the apertures 20 provide the ability to introduce air into the appliance air intake apparatus 100 and as such the furnace or other appliance to which the appliance air intake apparatus 100 is operably coupled providing an ability to maintain operation thereof when the primary air intake is inoperable. It is contemplated within the scope of the present invention that the body 10 could have as few as one aperture 20 or more than two apertures 20. Furthermore it should be understood within the scope of the present invention that the apertures 20 could be provided in alternate sizes and shapes.

Figure 4:
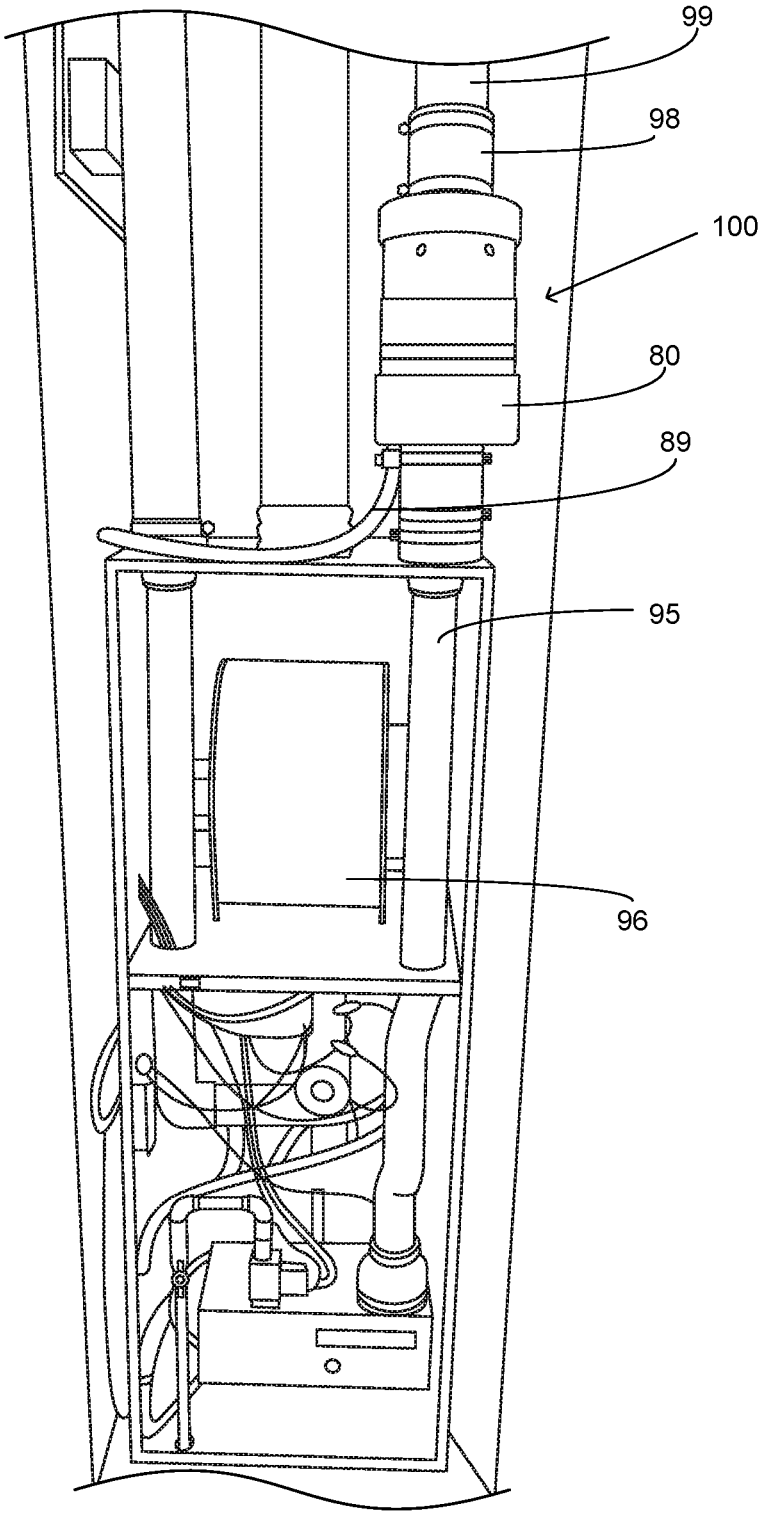
FIG. 4 is a perspective view of the present invention installed on an exemplary furnace.

Releasably secured to the first end 15 of the body 10 is the first end cap member 25. The first end cap member 25 is configured to cover the opening 18 proximate the first end 15. The first end cap member 25 is mateably shaped to couple with the first end 15 and is releasably secured thereto utilizing threads 23. It should be understood within the scope of the present invention that the first end cap member 25 could be releasably secured utilizing alternate techniques. The first end cap member 25 includes intake pipe 30. The intake pipe 30 includes an inner portion 31 and an upper portion 32 that are contiguously formed. The intake pipe 30 includes a hollow passage 33 therethrough that is operable to permit air to flow into the appliance air intake apparatus 100. As shown in FIG. 4 herein, the upper portion 32 of the intake pipe 30 is operably coupled with air intake 99 using coupling 98. The air intake 99 includes a portion that is atmospherically coupled with a fresh air source (not illustrated herein) and is operable to facilitate the introduction of fresh air into the appliance air intake apparatus 100. While no particular diameter of the inner portion 31 is required, good results have been achieved utilizing a diameter of four inches. Additionally, while no diameter for the upper portion 32 is required, good results have been achieved utilizing an upper portion 32 that has a diameter of three inches.

The appliance air intake apparatus 100 includes an intake member 40 that is operably disposed within the interior volume 12 of the body 10. The intake member 40 is secured to the interior surface 81 of the second end cap member 80 and extends upward into the interior volume 12 of the body 10. The intake member 40 is cylindrical in shape having a wall 41 wherein the wall 41 includes apertures 45 formed therein. The intake member 40 has a first end 46 and second end 47 wherein first end 46 is secured to the interior surface 81. Second end 47 has a cap member 49 operably secured thereto. The first end 46 has an opening (not illustrated herein) that is operable to fluidly couple the intake member 40 with exemplary pipe 95 as the second cap member 80 is additionally configured with an aperture (not illustrated herein) that is part of the intake member mount 84 providing the fluid coupling of the intake member 40 with pipe 95. Once assembled the inner portion 31 of the intake pipe 30 is surroundably present the intake member 40 with a void being therebetween allowing for airflow. The apertures 45 of the intake member 40 permit airflow through the intake member 40 and travel into pipe 95. The positioning of the intake member 40 and its apertures 45 being proximate the second end 47 allow the second end cap member 80 to collect any condensate that may form as a result of temperature differentials. The second end cap member 80 has a drain hole 88 that is coupled to hose 89 that facilitates the drainage of any condensate accumulation.

The body 10 has sleeve 70 slidably coupled thereto. The sleeve 70 is slidably secured to the exterior of the wall 11 of the body 10 and can be positioned to cover apertures 20 during performance of a blower door test so that an accurate test and reading can be achieved. The sleeve 70 is provided to cover the apertures 20 during such a test but is removed from covering the apertures 20 during normal operation. The interior surface of the wall 11 includes a mesh screen 55 mounted thereto utilizing suitable techniques. The mesh screen 55 is operable to inhibit bugs and other articles from entering the interior volume 12 of the body 10 via apertures 20. Additionally, the intake member 40 includes a screen 56 on the exterior surface thereof. Screen 56 provides coverage of apertures 45 so as to inhibit matter from passing therethrough and entering the furnace 96.

When in use the appliance air intake apparatus 100 has an airflow in a first mode and a second mode. In the first mode the fresh air intake is introduced into the appliance air intake apparatus 100 via primary air intake pipe 99 wherein the air will pass through the interior volume 12 of the body 10, through the apertures 45 of the intake member 40 and outwards from the first end 46 into the pipe 95. In the second mode, the primary air intake pipe 99 has been blocked due to a freeze or some other issue. When the primary air intake 99 is blocked the apertures 20 allow air to be introduced into the interior volume 12 providing continued operation. As air flows into apertures 20 the airflow then proceeds into the interior volume 12 of the body and has the same airflow pattern as described herein above expelling into pipe 95.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding description is, therefore, not intended to be limited to the specific forms set forth herein, but on the contrary, it is intended to cover such alternatives, modifications, and equivalents, as can be reasonably included within the spirit and scope of the invention.

What is claimed is:

1. An air intake apparatus configured to be operably coupled to a primary air intake of an appliance wherein the air intake apparatus comprises:

a body, said body having at least one wall, said body having a first end and a second end, said body having an interior volume, said body having an opening proximate said first end, said body having an opening proximate said second end, said body having a first end cap member, said first end cap member being secured to said first end of said body, said body having a second end cap member, said second end cap member being secured to said second end of said body, the first end cap member further includes an intake pipe, said intake pipe having a hollow passage therethrough, said intake pipe having an inner portion and an upper portion, said upper portion of said intake pipe extending outward from said first end cap member and said inner portion of said intake pipe extends downward from said first end cap member into the interior volume of said body;

an intake member, said intake member being disposed within said interior volume of said body, said intake member having at least one wall, said intake member having an interior volume, said intake member having at least one aperture in said at least one wall of said intake member, said intake member disposed within the hollow passage of said inner portion of the intake pipe; and wherein the air intake apparatus is operable to provide airflow to an appliance when the primary air intake is inoperable.

2. The air intake apparatus as recited in claim 1, wherein said at least one wall of said body further includes at least one aperture, said at least one aperture operable to atmospherically couple the interior volume of said body with external atmosphere present around the air intake apparatus.

3. The air intake apparatus as recited in claim 2, wherein said body further includes a sleeve, said sleeve being mounted exteriorly on said body, said sleeve being slidably coupled to said body.

4. The air intake apparatus as recited in claim 3, wherein said intake member further includes a cap member, said cap member being located on said intake member distal to said first end wherein said first end is operably coupled to an interior surface of said second cap member.

5. An air intake apparatus for a furnace wherein the air intake apparatus is operably coupled to a primary air input operable to introduce atmospheric air into the furnace wherein the air intake apparatus comprises:

a body, said body having a wall and being cylindrical in shape, said body having a first end and a second end, said body having an interior volume, said body having an opening proximate said first end, said body having an opening proximate said second end, said body having a first end cap member, said first end cap member being secured to said first end of said body, said body having a second end cap member, said second end cap member being secured to said second end of said body, said body having a plurality of apertures in said wall;

an intake member, said intake member having a first end and a second end, said intake member being cylindrical in shape and having a wall, said intake member being disposed within said interior volume of said body, said intake member having an interior volume, said intake member having a plurality of apertures in said wall, said intake member having a cap secured to said second end, said intake member being fluidly coupled to said interior volume of said body;

an intake pipe, said intake pipe being operably coupled to said first end cap member, said intake pipe having a hollow passage therethrough, said intake pipe having an inner portion and an upper portion, said upper portion of said intake pipe extending outward from said first end cap member, said upper portion of said intake pipe being operably coupled to the primary air input; and wherein the air intake apparatus is operable to provide airflow to the furnace when the primary air input is inoperable.

6. The air intake apparatus for a furnace as recited in claim 5, and further including a sleeve, said sleeve being slidably mounted exteriorly on said body, said sleeve configured to be slidable between a first position and a second position, wherein in said first position said sleeve is operable to inhibit airflow through said plurality of apertures formed in said wall of said body.

7. The air intake apparatus for a furnace as recited in claim 6, wherein said intake member is disposed within the hollow passage of said inner portion of said intake pipe.

8. The air intake apparatus for a furnace as recited in claim 7, wherein said second end cap member further includes a drain hole, said drain hole being operably coupled to a drain hose so as to remove condensate from the interior volume of said body.

9. The air intake apparatus for a furnace as recited in claim 8, wherein said body further has a mesh screen disposed on an interior surface of said wall of said body.

10. The air intake apparatus for a furnace as recited in claim 9, wherein in said second position said sleeve is positioned so as to be removed from said plurality of apertures on said wall of said body in order to permit airflow therethrough into said interior volume of said body.

11. The air intake apparatus for a furnace as recited in claim 10, wherein said intake member includes a mesh screen surroundably mounted thereto.

12. An air intake apparatus for a furnace wherein the air intake apparatus is operably coupled to a primary air input operable to introduce atmospheric air into the furnace wherein the air intake apparatus comprises:

a body, said body having a wall and being cylindrical in shape, said body having a first end and a second end, said body having an interior volume, said body having an opening proximate said first end, said body having an opening proximate said second end, said body having a first end cap member, said first end cap member being secured to said first end of said body, said body having a second end cap member, said second end cap member being secured to said second end of said body, said body having a plurality of apertures in said wall;

an intake member, said intake member having a first end and a second end, said intake member being cylindrical in shape and having a wall, said intake member being disposed within said interior volume of said body, said intake member having an interior volume, said intake member having a plurality of apertures in said wall, said intake member having a cap secured to said second end, said intake member being fluidly coupled to said interior volume of said body;

an intake pipe, said intake pipe being operably coupled to said first end cap member, said intake pipe having a hollow passage therethrough, said intake pipe having an inner portion and an upper portion, said upper portion of said intake pipe extending outward from said first end cap member, said upper portion of said intake pipe being operably coupled to the primary air input;

a sleeve, said sleeve being slidably mounted exteriorly on said body, said sleeve configured to be slidable between a first position and a second position, wherein in said first position said sleeve is operable to inhibit airflow through said plurality of apertures formed in said wall of said body;

wherein the air intake apparatus is operable to provide airflow to the furnace when the primary air input is inoperable.

13. The air intake apparatus for a furnace as recited in claim 12, wherein said second end cap member further includes a drain hole, said drain hole being operably coupled to a drain hose so as to remove condensate from the interior volume of said body.

14. The air intake apparatus for a furnace as recited in claim 13, wherein said intake member is disposed within the hollow passage of said inner portion of said intake pipe.

15. The air intake apparatus for a furnace as recited in claim 14, wherein in said second position said sleeve is positioned so as to be removed from said plurality of apertures on said wall of said body in order to permit airflow therethrough.

16. The air intake apparatus for a furnace as recited in claim 15, wherein said intake member includes a mesh screen surroundably mounted thereto.

17. The air intake apparatus for a furnace as recited in claim 16, wherein said body further has a mesh screen disposed on an interior surface of said wall of said body.

* * * * *